US005921182A

United States Patent [19]

Becker et al.

[11] Patent Number: 5,921,182

[45] Date of Patent: Jul. 13, 1999

[54] CLEANING DEVICE PROVIDED ON A ROTARY PRINTING MACHINE

[75] Inventors: Willi Becker, Bammental; Jens Friedrichs, Heidelberg; Frank Kropp, Neckarsteinach, all of Germany

[73] Assignee: Heidelberger Druckmaschinen Aktiengesellschaft, Heidelberg, Germany

[21] Appl. No.: 08/822,590

[22] Filed: Mar. 20, 1997

[30] Foreign Application Priority Data

Mar. 21, 1996 [DE] Germany ..... 196 11 126

[51] Int. Cl.[6] ..... B41F 35/00

[52] U.S. Cl. ..... 101/425; 101/423

[58] Field of Search ..... 101/425, 423, 101/424; 15/256.5, 256.51, 256.52

[56] References Cited

U.S. PATENT DOCUMENTS

| | | | |
|---|---|---|---|
| 4,270,450 | 6/1981 | Difflipp et al. | 101/142 |
| 4,922,821 | 5/1990 | Nozaka et al. | 101/425 |
| 5,271,326 | 12/1993 | Ebina | 101/425 |
| 5,317,969 | 6/1994 | Tateishi | 101/425 |

FOREIGN PATENT DOCUMENTS

| | | |
|---|---|---|
| 1270147 | 6/1990 | Canada . |
| 0257818 | 3/1988 | European Pat. Off. . |
| 0315154 | 5/1989 | European Pat. Off. . |
| 0445600 | 9/1991 | European Pat. Off. . |
| 3614496 | 11/1987 | Germany . |

*Primary Examiner*—Edgar Burr
*Assistant Examiner*—Anthony H. Nguyen
*Attorney, Agent, or Firm*—Nils H. Ljungman & Associates

[57] ABSTRACT

A cleaning device for cleaning an outer cylindrical surface of an impression cylinder of a rotary printing machine includes a cleaning cloth pressed against the outer cylindrical surface by a beam. The beam is pivotally mounted to engage the cleaning cloth with the outer cylindrical surface upon pressurization of a pneumatic cylinder. A spring pivotally returns the beam to disengage the cleaning cloth with the outer cylindrical surface upon depressurization of the pneumatic cylinder. To assure radial clearance between the cleaning device and the gripper fingers of the impression cylinder, the pneumatic cylinder is depressurized at a first angular position of the impression cylinder and the pneumatic cylinder is subsequently pressurized at a second angular position of the impression cylinder. The first and second angular positions of the impression cylinder correspond respectively to the cleaning device nearing the vicinity of the gripper fingers and the cleaning device leaving the vicinity of the gripper fingers. The cleaning device includes a cam roller that engages a cam plate attached to the impression cylinder to control the engagement of the cleaning device with the outer cylindrical surface upon the pressurization of the pneumatic cylinder.

9 Claims, 7 Drawing Sheets

CLEANING DEVICE PROVIDED ON A ROTARY PRINTING MACHINE

BACKGROUND OF THE INVENTION

1. Field of the Invention

The present invention relates generally to a cleaning device provided on a rotary printing machine for cleaning outer cylindrical surfaces of cylinders. The cleaning device can include a cleaning cloth and a pressing-on bar for pressing the cleaning cloth on the outer cylindrical surface of a respective cylinder. The cleaning cloth can be wetted with a cleaning fluid. The cleaning device can also include adjusting devices for engaging and disengaging the pressing-on bar with the cleaning cloth. The cylinder to be cleaned can include gripper fingers in a cylinder gap.

2. Background Information

According to a known cleaning device as disclosed in European Patent No. 0 257 818 B1, the pressing-on device is lifted, via a cam device, against the pressure of the contact cylinder. Given a rather high cleaning velocity, the cam follower causes great impacts when coming into contact with the cam. A further disadvantage is that the entire device, together with the cloth rolls, has to be moved so that considerable forces are required to overcome the inertia.

OBJECT OF THE INVENTION

Proceeding from the state of the art it is the object of the present invention to optimally control the cleaning device so that the cleaning time may be reduced.

SUMMARY OF THE INVENTION

According to the present invention, this object can be achieved in that after each cleaning cycle, following an adjusting signal, the pressing-on bar can be lifted by a lifting element above the level of the gripper fingers. In the area of the gripper fingers the cylinder can include a cam segment. A pivoting lever with a cam roll can be provided on the pressing-on bar. Preferably in the area of the gripper fingers, a pressing-on force can be applied to the pressing-on bar; and the cam roll can thereby come into contact with the highest cam section. The cam segment can include a declining cam section so that, after having passed the gripper fingers, the pressing-on bar can be engaged, via the cam roll and the pivoting lever, at the outer cylindrical surface over the entire cylinder width, when further rotating the cylinder.

In accordance with the present invention, preferably merely a pressing-on bar having relatively little mass need be moved. The pressing-on bar can be lifted in the area of the cylinder gap over a relatively long circumferential distance of the cylinder, and thus the pressing-on bar can be lifted relatively slowly. As a result thereof, any impacts which might have detrimental effects can be substantially avoided. Because the cam roll can roll off on the cam section and can be simultaneously pressed on the cam section, it can essentially be ensured that the cleaning cloth can relatively precisely contact the outer cylindrical surface substantially immediately behind the gripper fingers so that the outer cylindrical surface may, in effect, be entirely cleaned. As relatively hard impacts can be avoided, the cleaning process may be carried out at relatively high machine speeds, and thus the time required for cleaning may be reduced.

In an advantageous embodiment of the present invention, pneumatic cylinders can preferably produce a pressing-on force. The pneumatic cylinders can be assigned to the pressing-on bar, so that, via an elastic profile rail provided on the pressing-on bar, the cleaning cloth can be pressed on the outer cylindrical surface. The pneumatic cylinders can produce a substantially uniform pressing-on force, so that by means of the cleaning cloth the profile rail may thoroughly clean the outer cylindrical surface.

In accordance with a yet additional embodiment of the present invention, the overpressure in the pneumatic cylinders can be switched off via an adjusting signal. Springs provided on the pressing-on bar can preferably serve as lifting elements, the springs preferably lifting the pressing-on bar in the area of the cylinder gap. The switching-off of the overpressure may be delayed so that the pressing-on bar may be lifted slowly over a relatively long area. This embodiment can substantially prevent any detrimental impacts.

Furthermore, in order to carry out a relatively exact adjustment, the present invention teaches to engage the pressing-on bar, when being in its lifted position, at a supporting frame via stops and to adjust it (the pressing-on bar), when being in its engaged position, by means of adjusting screws. A further advantage can be that the pressure in the pneumatic cylinders can preferably be controlled via an angular transmitter. This can ensure a relatively reliable and harmonic process. The adjusting signal for the lifting element can, for a possible embodiment, be advantageously transmitted by an angular transmitter connected to the cylinder. This embodiment can make it possible to control the cleaning device, ensuring a relatively optimal and short-term cleaning of the outer cylindrical surface, given relatively low inertial forces.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby asserts that the disclosure of this application may include more than one invention, and, in the event that there is more than one invention, that these inventions may be patentable and non-obvious one with respect to the other.

BRIEF DESCRIPTION OF THE DRAWINGS

Specimen embodiments of the present invention are schematically illustrated in the drawings, in which.

DESCRIPTION OF THE PREFERRED EMBODIMENT

Figure 1:
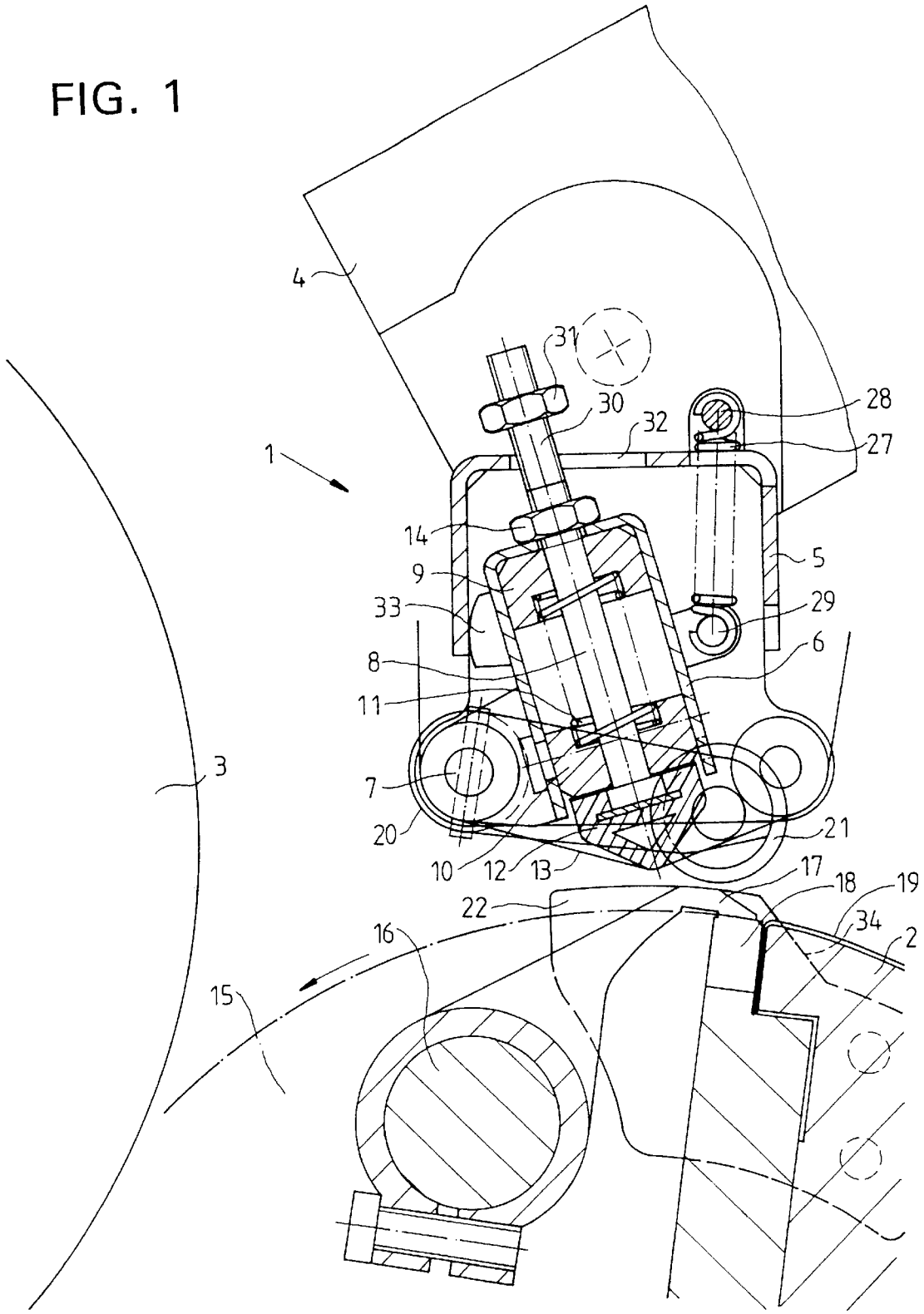
FIG. 1 is a partial cross-sectional view of a cleaning device, with the pressing-on bar being in a lifted position.

As shown in FIG. 1, a cleaning device 1 can be engaged at an impression cylinder 2 or, by pivoting the cleaning device 1 in its support 4, at a blanket cylinder 3. The support 4 can be provided between the machine side frames (not shown) on both sides of the cleaning device 1, so that the cleaning device 1 can be removed.

A beam or pressing-on bar 6, preferably extending over the length of the impression cylinder 2, can be provided in a supporting frame 5. The supporting frame 5 preferably is pivot-mounted between the supports 4. Via pivots 7, the pressing-on bar 6 can be pivot-mounted, on both sides thereof, on the supporting frame 5. Seen over the length of the pressing-on bar 6, the pressing-on bar 6 can accommodate a plurality of springs bolts 8 guided in guiding bodies 9, 10. A compression spring 11 can act on guiding body 10 so that a profile rail 12 can be resiliently supported by means of the guiding body 10. The pressing-on bar 6 can guide a cleaning cloth 13. Nuts 14 can be provided on the spring bolts 8, to permit an adjustment of the spring deflection and, when the nuts 14 come in contact with the pressing-on bar 6, to limit the spring deflection.

For possible embodiments of the present invention, the cleaning cloth 13 can be wettable with a cleaning fluid (not shown).

Figure 2:
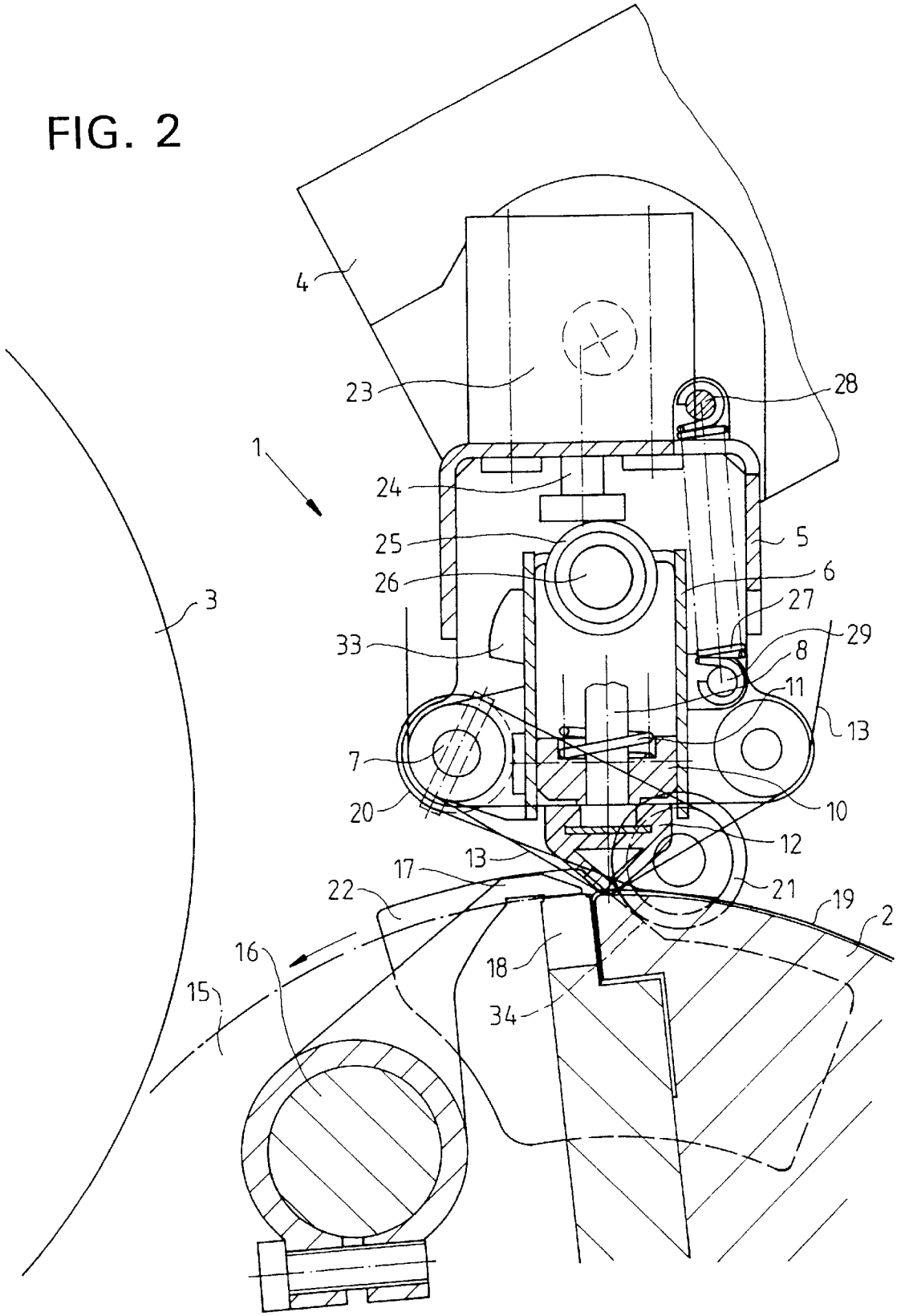
FIG. 2 is a partial cross-sectional view of the cleaning device, with the cleaning cloth being in contact with the outer cylindrical surface.

Seen over the length of the impression cylinder 2, a plurality of gripper fingers 17 can cooperate with a gripper pad 18, each of which gripper fingers 17 and pad 18 can be provided in a cylinder gap 15 of the impression cylinder 2. The gripper fingers 17 can project beyond an outer cylindrical surface 19 of the impression cylinder 2 as shown in FIGS. 1 and 2. The outer cylindrical surface 19 of the impression cylinder 2 can be covered with a foil or printing plate (not shown), which foil can be cleaned by the cleaning device 1.

In a possible embodiment of the present invention, the gripper fingers 17 can be mounted on a shaft 16.

Pivoting levers 20, preferably carrying cam rollers or cam followers or cam rolls 21, can be fastened to the pivots 7 of the pressing-on bar 6 on one side or, in a possible alternative embodiment, on both sides of the pressing-on bar 6. In the area of the gripper fingers 17, cams or cam segments 22 can be fastened to the impression cylinder 2. During the rotary motion of the impression cylinder 2, the cam segments 22 can roll off the cam rolls 21.

Pneumatic cylinders 23 (see FIGS. 2 and 3) can be fastened to the supporting frame 5. Piston rods 24 of the pneumatic cylinders 23, when the pneumatic cylinders 23 are preferably overpressurized or actuated by a pressure medium, can preferably pivot the pressing-on bar 6 about the pivots 7 downwards via rolls 25. Via journals 26, the rolls 25 can be fastened to the pressing-on bar 6 (see FIGS. 2 and 3). If the overpressure in the pneumatic cylinders 23 is switched off, the pressing-on bar 6 can be moved back, preferably by means of tension springs 27, into the position shown in FIG. 1. Thus the profile rail 12, with the cleaning cloth 13, can be lifted off the outer cylindrical surface 19. The tension springs 27 can be tensioned between pins 28 fastened to the supporting frame 5 and pins 29 fastened to the pressing-on bar 6.

Figure 3:
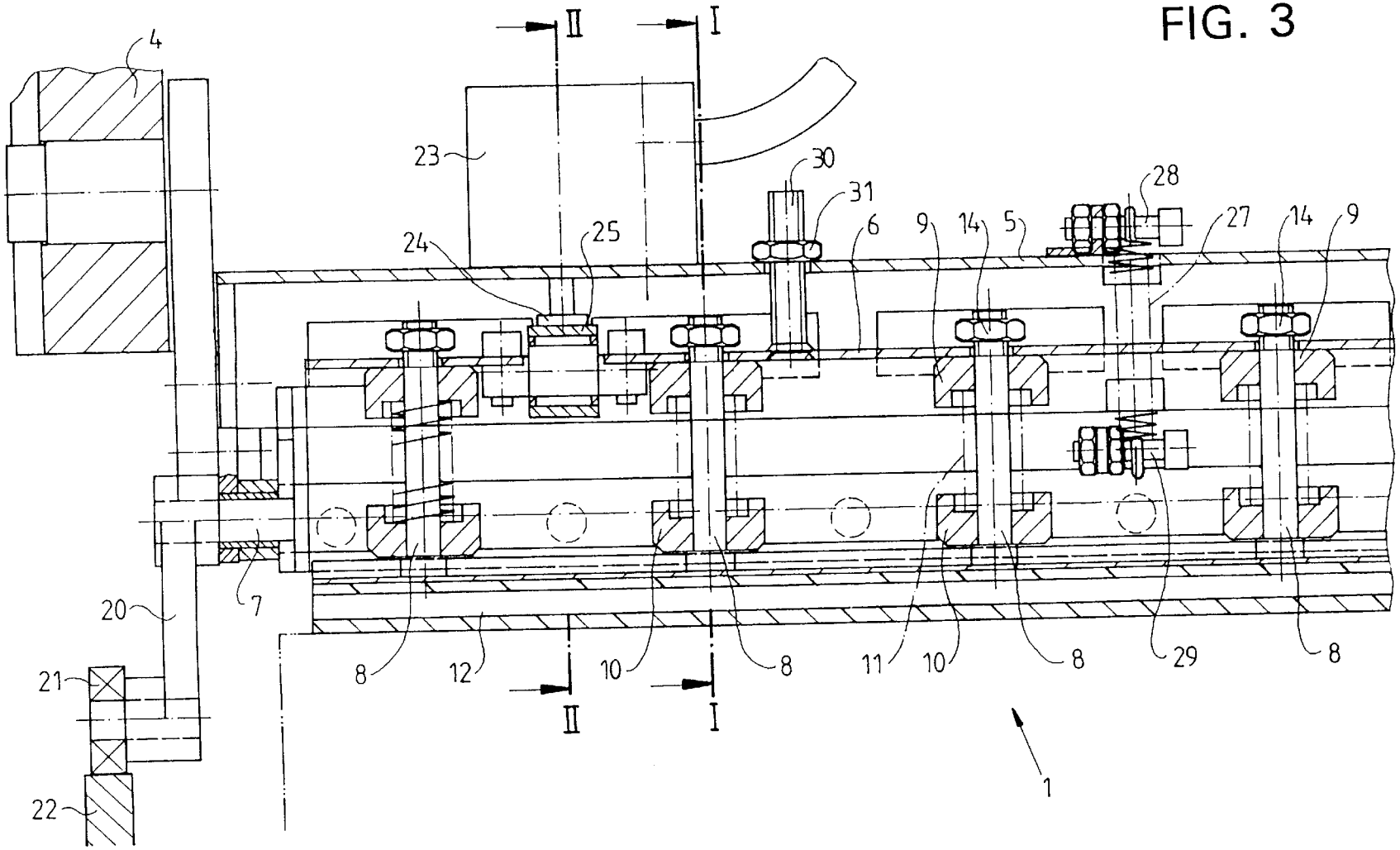
FIG. 3 is a partial section view of the cleaning device taken in longitudinal direction.

In other words, for a possible embodiment, the pneumatic cylinders 23 can be used to pivot the pressing-on bar 6 about the pivots 7 to engage and disengage the cleaning cloth 13 with the outer cylindrical surface 19 of the plate cylinder or impression cylinder 2. Although only one pneumatic cylinder 23 is shown in FIGS. 2 and 3, it should be recognized that a plurality of these pneumatic cylinders 23 can be used. Pressurizing the pneumatic cylinders 23 can extend each corresponding piston rod 24 to place the cleaning device 1 in the position shown in FIG. 2. Depressurizing the pneumatic cylinders 23 can retract each corresponding piston rod 24 to place the cleaning device in the position shown in FIG. 1. The tension springs 27 can store energy during the pivoting of the pressing-on bar 6 in response to extension of the piston rods 24, the stored energy in the tension springs 27 preferably being used to return the pressing-on element 6 to the disengaged position shown in FIG. 1 upon depressurization of the pneumatic cylinders 23.

Threaded bolts 30 can be provided on the pressing-on bar 6 in order to limit the engaging movement of the cleaning cloth 13 via piston rod 24. Each of the threaded bolts 30 can carry an adjusting nut 31; in the position shown in FIG. 1, where the pressing-on bar 6 is preferably pivoted away, the threaded bolts 30 can be provided in a slit 32 so as to be freely movable. If the pressing-on bar 6 is pivoted into the position shown in FIG. 2, the adjusting nuts 31 can rest on the supporting frame 5, and thereby limit the pivoting movement of the pressing-on bar 6 towards the outer cylindrical surface 19 of the impression cylinder 2.

In the position shown in FIG. 1, in which position the pressing-on bar 6 is pivoted away from the impression cylinder 2, the pressing-on bar 6 can be engaged at the supporting frame 5 via stops 33. During the rotary movement of the impression cylinder 2, an adjusting signal can be emitted in the area of the cylinder gap 15, for example, via an angular transmitter or sensing device 90 (see FIGS. 3 and 4). The adjusting signal can preferably cause the overpressure in the pneumatic cylinders 23 to be switched off. Via a lifting element 27, preferably designed as a tension spring 27, the pressing-on bar 6 with the cleaning cloth 13 can be pivoted into the position shown in FIG. 1.

In the area of the highest cam section 222 (see FIGS. 3 and 4) of the cam segment 22, the pneumatic cylinders 23 can again be supplied with pressure, or in other words overpressurized or actuated, so that the cam roll 21 can contact the highest section of the cam segment 22. If the impression cylinder 2 preferably continues to rotate in direction of the arrow, each of the piston rods 24 can urge the pressing-on bar 6 downwards. This downward movement can preferably be controlled via the cam roll 21 according to the declining cam section 34 (as shown in FIG. 2). As soon as the adjusting nut 31 of the threaded bolt 30 can rest on the outer surface of the supporting frame 5, the pivoting movement of the pressing-on bar 6 can be terminated, and the tip of the elastic profile rail 12 can press the cleaning cloth 13 on the outer cylindrical surface 19 of the impression cylinder 2. In this embodiment, there preferably is no contact between cam roll 21 and cam segment 22. The adjusting signal for the control of the cleaning device 1 may be emitted by a known angular transmitter, which angular transmitter, for possible embodiments of the present invention, may be fastened to the impression cylinder 2.

Figure 4:
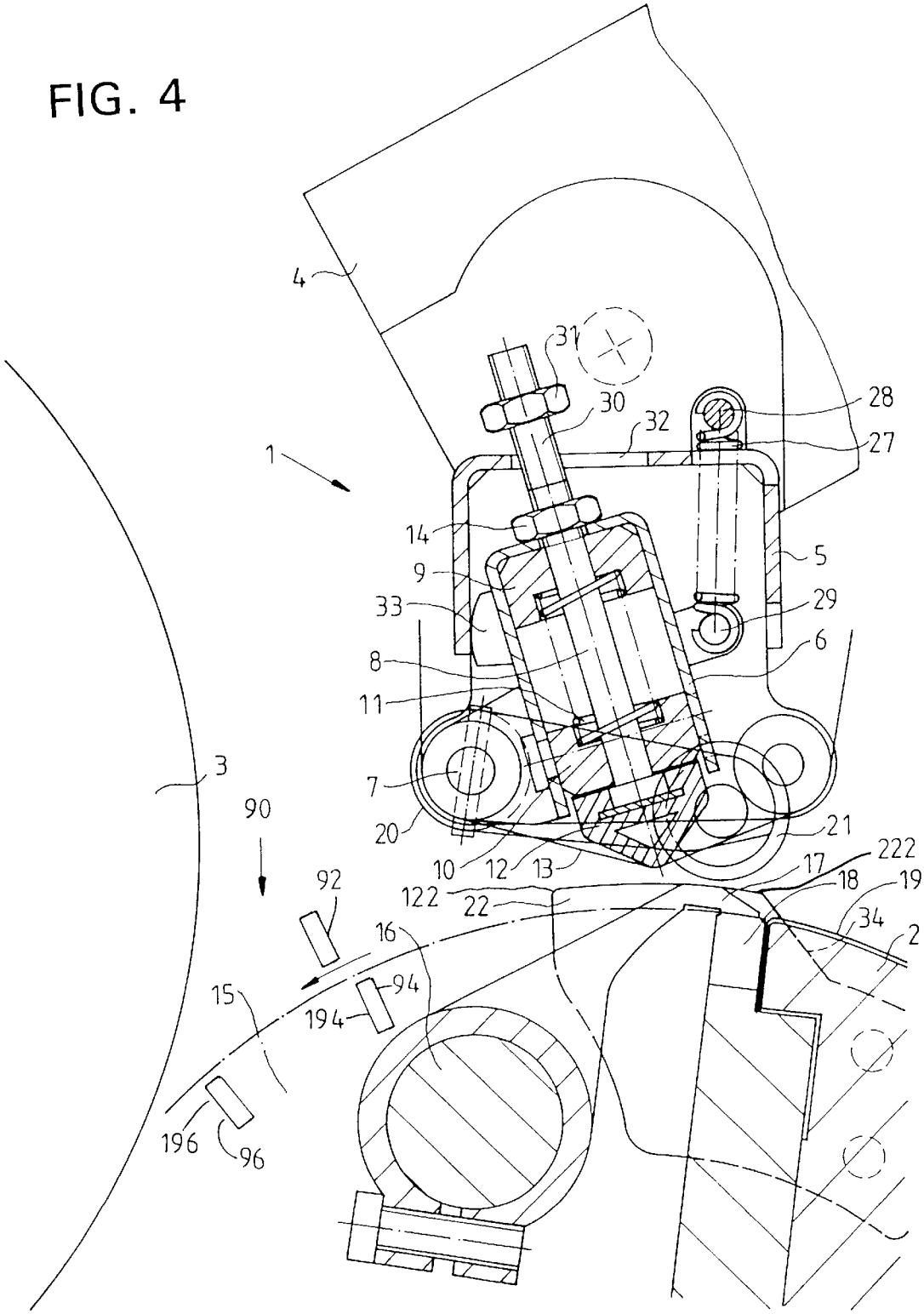
FIG. 4 is a partial cross-sectional view of another possible embodiment of a cleaning device, with the pressing-on bar being in a lifted position.
Figure 5:
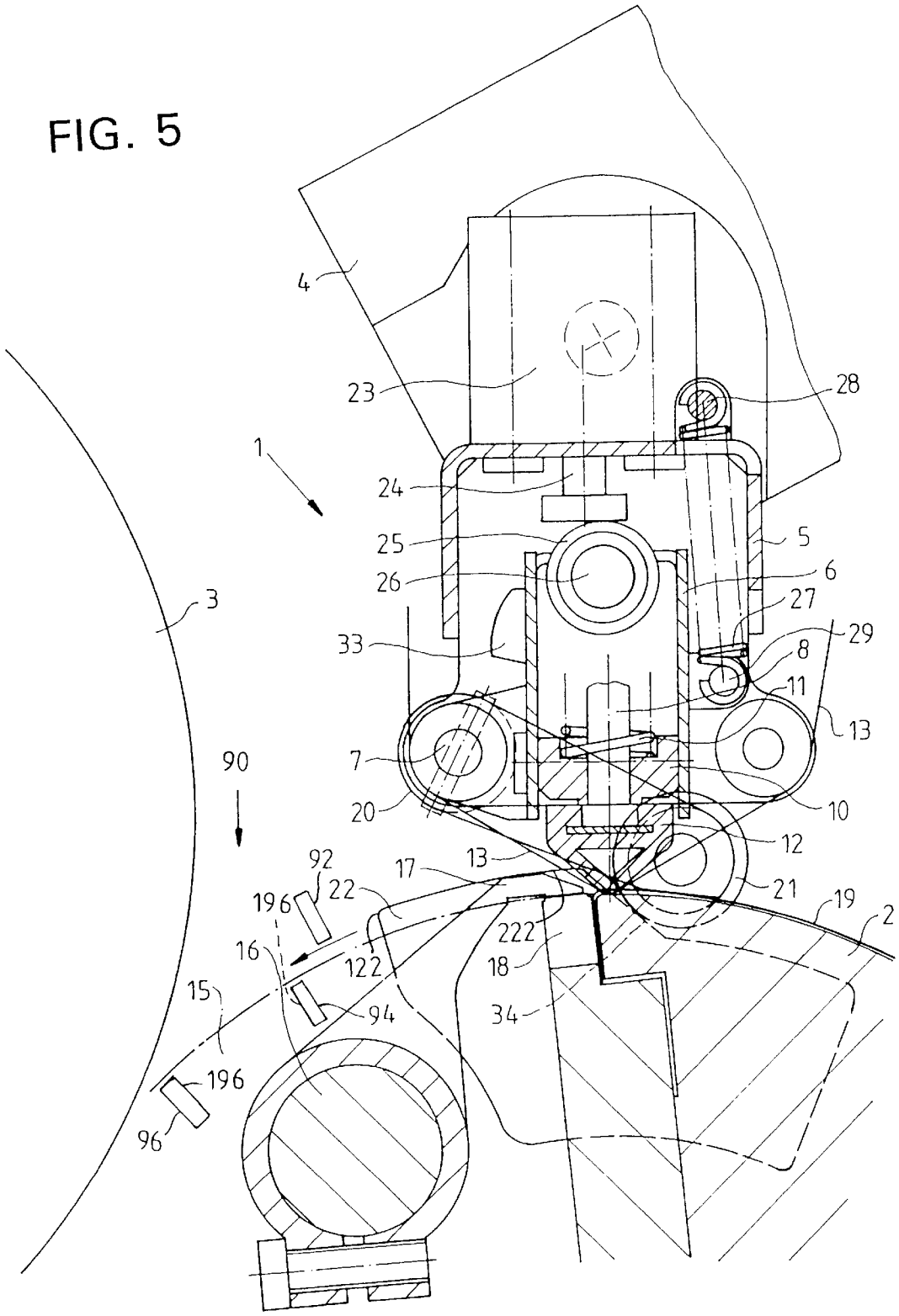
FIG. 5 is a partial cross-sectional view of the embodiment shown in FIG. 4, with the cleaning cloth being in contact with the outer cylindrical surface.
Figure 6:
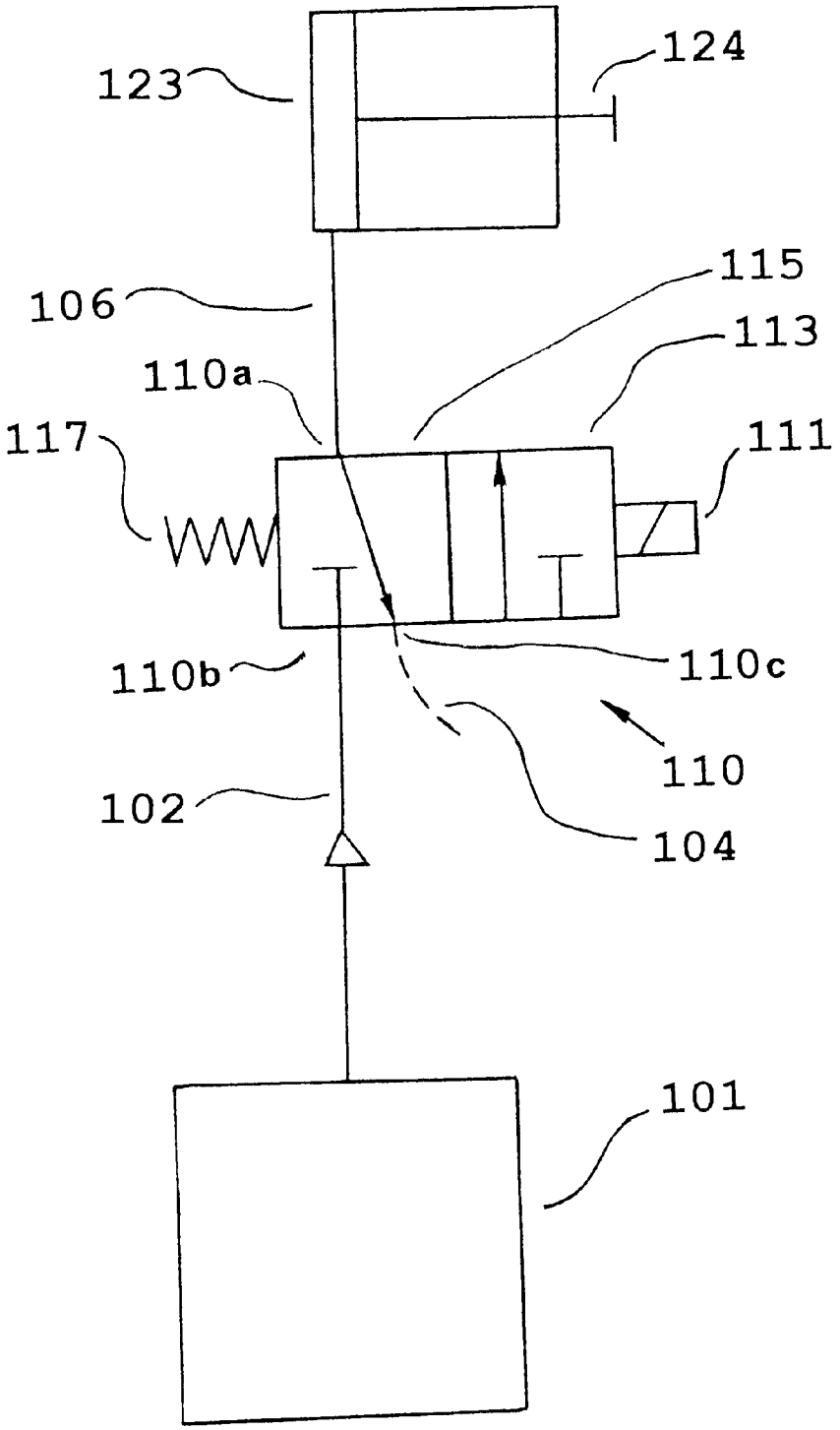
FIG. 6 is a schematic diagram of a pneumatic circuit that can be used in a possible embodiment of the cleaning device.

In other words, for a possible embodiment of the present invention as shown in FIGS. 4–6, an angular transmitter or sensing device 90 (see FIG. 4) can be used to control the actuation of the pneumatic cylinders 23 (note that features of the embodiments shown in FIGS. 4–6 that correspond to the features of the embodiments shown in FIGS. 1–3 have corresponding reference numerals). The sensing device 90 can include a sensor 92, which sensor 92 can be fixedly positioned with respect to the axis of rotation of the impression cylinder 2. The sensor 92 can be considered a fixed position sensor 92, and, for a possible embodiment of the present invention, can be attached to one of the side frames (not shown) of the printing machine. The sensor 92 can be located near an axial end of the impression cylinder 2. The sensing device 90 can also include two additional sensors 94 and 96, each sensor 94 and 96 preferably attached to the corresponding end of the impression cylinder 2 adjacent the sensor 92. The sensors 94 and 96 can each be attached to rotate with the impression cylinder 2 about the axis of rotation of the impression cylinder 2, and the sensors 94 and 96 can preferably be circumferentially offset from one another near the outer diameter of the impression cylinder 2.

The sensing device 90 can be arranged and configured so that the sensor 96, and then the following sensor 94, can successively pass in relatively close proximity to the sensor 92 as the impression cylinder 2 rotates in the direction shown in FIGS. 4 and 5. When passing in proximity to the sensor 92, each of the sensors 94 and 96 can individually detect the presence of the sensor 92, and thereby can individually determine a corresponding position of the impression cylinder 2 during displacement of the impression cylinder 2.

When sensor 96 detects or senses the sensor 92 during a rotation of the impression cylinder 2, the angular position of the impression cylinder 2 at that point can preferably locate the cleaning device 1 adjacent the cylinder gap 15. It can therefore be desirable, when the sensor 96 senses the sensor 92, to deactuate or depressurize the pneumatic cylinders 23, and thereby cause the pressing-on bar 6 to pivot away from the impression cylinder 2 and position the cleaning device 1 in the position corresponding to that shown in FIG. 4. Upon sensing the sensor 92, the sensor 96 can preferably generate, transmit or communicate a signal 196 to deactuate or depressurize the pneumatic cylinders 23.

FIG. 4 illustrates the sensor 96 already having passed the sensor 92. The sensor 96 has already preferably transmitted an adjusting signal to depressurize the pneumatic cylinders 23, and in response to the depressurization of the pneumatic cylinders 23, the pressing-on bar 6 can pivot away from the impression cylinder 2 to prevent the cam roller 21 from contacting or striking a leading or forward edge 122 of the cam section 22.

The position of the impression cylinder 2 in the embodiment shown in FIG. 4 can correspond to the position of the impression cylinder 2 as shown in FIG. 1. The cam roller 21 is now adjacent a highest cam section 222, and it can be preferable to now actuate or pressurize the pneumatic cylinders 23 so that the cam roller 21 can come into camming contact with the highest cam section 222 to begin camming contact with the declining cam section 34. The sensor 94 is now preferably in the proximity of the sensor 92, and the sensor 94 can preferably now sense or detect the sensor 92, again determining the angular position of the impression cylinder 2. In response to sensing the sensor 92, the sensor 94 can generate, transmit or communicate a signal 194 to actuate or pressurize the pneumatic cylinder 23, thereby pivoting the press-on bar 6 towards the impression cylinder 2. The cam roll or cam roller 21 can thereby come into camming contact with the highest cam section 222 of the cam section 22.

The position of the impression cylinder 2 in the embodiment shown in FIG. 5 can correspond to the position of the impression cylinder 2 as shown in FIG. 2. The sensor 94 preferably has passed the sensor 92, and the pneumatic cylinders 23 have been pressurized to engage the washing device 1 with the outer surface 19 of the impression cylinder 2. As shown in FIG. 5, the cam roller 21 can now be in contact with the declining cam section 34. The pneumatic cylinders 23 can remain pressurized to engage the cleaning cloth 13 with the outer surface 19 of the impression cylinder 2, until rotation of the impression cylinder 2 again can allow the sensor 96 to sense the sensor 92 and depressurize the pneumatic cylinders 23.

For the embodiments shown in FIGS. 4 and 5, the sensing device 90 can use known magnetic sensors 92, 94 and 96. The sensor 92 can include a magnet, and each of the sensors 94 and 96 can detect the magnetic field of the magnet included with sensor 92 to "sense" or determine the proximate presence of the sensor 92. In other possible embodiments of the present invention, the sensors 92, 94 and 96 can be realized as known proximity sensors or mark sensors or photoelectric sensors, for example.

As shown in FIGS. 4 and 5, the circumferential location of the sensor 96 when the sensor 96 senses the sensor 92 can preferably correspond to a first angular position of the impression cylinder 2, wherein the cam roller 21 can be located in the area of the cylinder gap 15. The circumferential location of the sensor 94 when the sensor 94 senses the sensor 92 can preferably correspond to a second angular position of the impression cylinder 2, wherein the cam roller 21 can be located adjacent the area of the highest cam section 222. In possible embodiments of the present invention, it can be desirable to deactuate or depressurize the pneumatic cylinders 23 when the impression cylinder 2 has reached the first angular position to assure radial clearance between the cleaning device 1 and the gripper fingers 17, and to keep the pneumatic cylinders 23 deactuated or depressurized until the impression cylinder 2 has reached its second angular position. Upon the reaching the second angular position of the impression cylinder 2, it can be desirable to actuate or pressurize the pneumatic cylinders 23, to cause the cam roller 21 to make camming contact with the declining cam portion 34 and engage the cleaning cloth 13 with the outer surface 19 of the impression cylinder 2, until the impression cylinder 2 has again rotated to its first angular position.

The determination of the first and second positions of the impression cylinder 2 can, for possible embodiments of the present invention, be done with other known types of sensing devices 90. For example, the rotation of the impression cylinder 2 can be converted into an electric current or voltage, whereby the angular position of the impression cylinder 2 can be obtained by detecting the corresponding current or voltage via a rotary encoder. Proximity switches, limit switches, photoelectric switches, limit sensors, mark sensors, photointeracter sensors, capacitance sensors, reluctance sensors and optical sensors, among others, can be used to construct the angular transmitter or sensing device 90 to satisfy particular design requirements of a particular embodiment of the present invention. The position of the grippers 17 can, in another possible embodiment, be detected directly by locating a switch or sensor near the impression cylinder 2. In an additional possible embodiment, the sensor 92 can be located on the impression cylinder 2 and the sensors 94 and 96 can be fixedly positioned with respect to the axis of rotation of the impression cylinder 2.

To pressurize and depressurize the pneumatic cylinders 23, the signals transmitted or communicated from the sensing device 90 (that is, for a possible embodiment, the signals transmitted by the sensors 94 and 96 in detecting the sensor 92) can operatively open or close a valve 110 (see FIG. 6)

to connect or disconnect the pneumatic cylinders 23 from a source of compressed air 101.

As shown schematically in FIG. 6 for a possible embodiment of the present invention, the source of compressed air 101 can be operatively connected to a pneumatic cylinder 123. The pneumatic cylinder 123 can correspond to each of the pneumatic cylinders 23 shown in FIGS. 1–5, and is schematically shown as a single-acting pneumatic cylinder 123 (i.e., a pneumatic cylinder 123 wherein the compressed air pressurizes only one side of the piston contained in the pneumatic cylinder). The pneumatic cylinder can include a piston rod 124, which piston rod 124 can correspond to the piston rod 24 for each of the pneumatic cylinders 23 as shown in FIGS. 2, 3 and 5.

A pneumatic line 102 can connect the compressed air source 101 to the valve apparatus or valve 110. The valve 110 can be connected to the pneumatic cylinder 123 by a second pneumatic line 106. In possible embodiments of the present invention that include a plurality of pneumatic cylinders 123, the second pneumatic line 106 can also represent a manifold or header (not shown) to permit distribution of compressed air from the valve apparatus 110 to each of the pneumatic cylinders 123.

For the possible embodiment shown in FIG. 6, the valve 110 can preferably be realized as a two-position, three-port (or three-way) shutoff valve 110. The valve 110 can be operable in two positions, 113 and 115. Each position 113 and 115 of the valve 110 can include three ports, 110*a*, 110*b* and 110*c* (shown for valve position 115). Port 110*a* can be an input port or output port, and can be connected to pneumatic line 106. Port 110*b* can be an input port to connect the pneumatic line 102 to the valve 110. Port 110*c* can be an outlet port connected to a pneumatic relief or exhaust line 104. The ports 110*a*, 110*b* and 110*c* for the position 115 of the valve 110 are shown in FIG. 6, but the position 113 preferably also includes corresponding ports (not shown) of the valve 110.

As illustrated in FIG. 6, the default position for the valve 110 is preferably position 115. In this position 115 of the valve 110, the pneumatic cylinder 123 can preferably be disconnected from the compressed air source 101. The port 110*b* can terminate in a shut-off or closed valve portion to prevent communication with port 110*a*, and can prevent the compressed air source 101 from being operatively connected to the pneumatic cylinder 123. The pneumatic line 106 can be connected to the exhaust line 104 via a connection between ports 110*a* and 110*c*, permitting air to escape from the pneumatic cylinder 123 through the pneumatic line 106 during a return stroke of the piston rod 124. For possible embodiments of the present invention, throttling devices (not shown) can be attached to the exhaust line 104 to further control the exhaust of pressure from the pneumatic cylinder 123. When the valve 110 is in position 115, the pressurized cylinder 123 can assume a deactivated or unpressurized state to operatively retract the piston rod 124.

To switch the valve 110 from the position 115 to the position 113, a solenoid 111 can be operatively connected to the valve 110. The solenoid 111 can be energized to switch the valve 110 from valve position 115 to valve position 113. A biasing apparatus or spring 117 can be operatively connected to the valve 110. The spring 117 can return the valve 110 to a default position 115 upon a deenergizing of the solenoid 111.

When the valve 110 is positioned in position 113, the pneumatic line 102 is operatively connected, via connection of ports 110*a* and 110*b* with the pneumatic line 106, to pressurize or actuate the pneumatic cylinder 123. The exhaust line 104 is disconnected from the pneumatic cylinder 123, that is, port 110*b* is preferably no longer connected to port 110*a*. When the valve 110 is in position 113, the pneumatic cylinder 123 can assume an actuated or pressurized state to operatively extend the piston rod 124.

Figure 7:
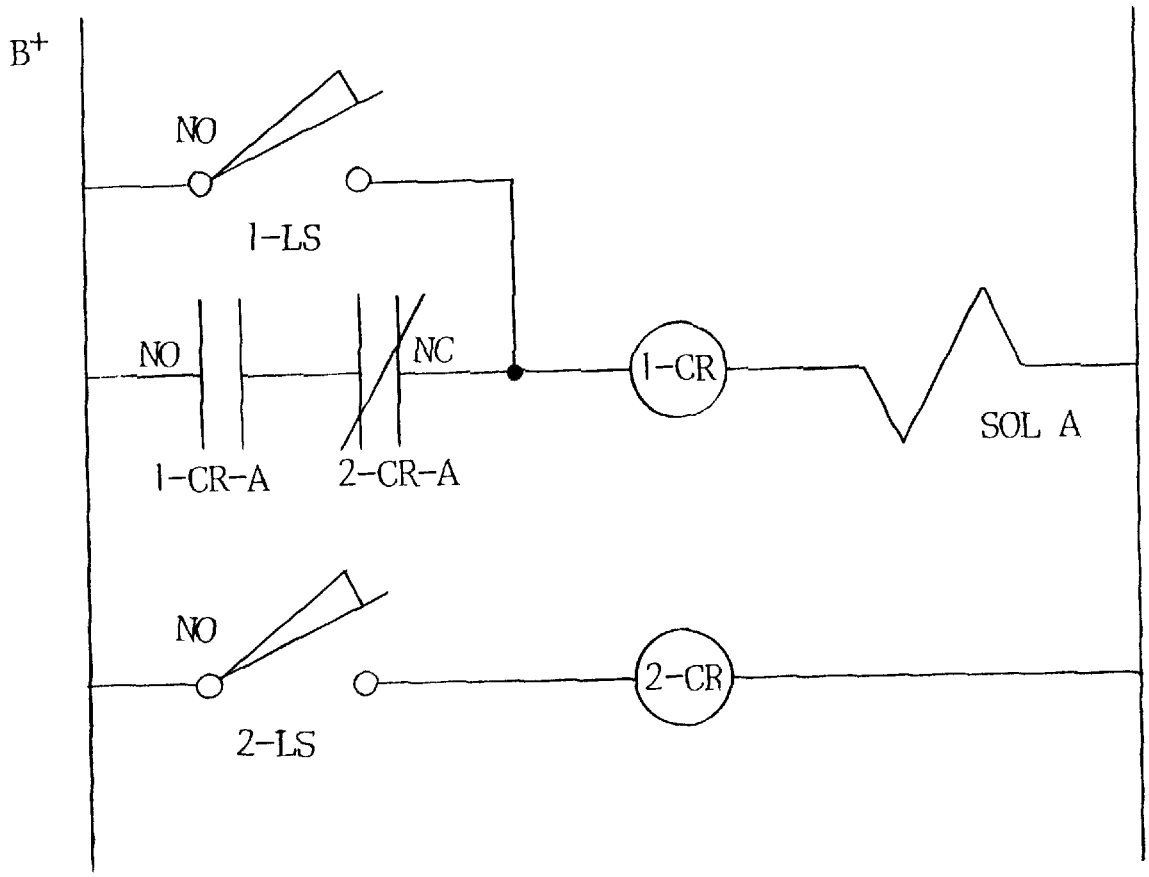
FIG. 7 is a schematic diagram of a control circuit that can be used in a possible embodiment of the cleaning device.

FIG. 7 illustrates schematically, for a possible embodiment of the present invention, a control circuit to pressurize and depressurize the pneumatic cylinders 23 and 123 as a function of the angular position of the impression cylinder 2. The "hot" side of the control circuit can be side $B^+$. The sensor 94 can, for a possible embodiment, be considered a limit switch 1-LS that is preferably normally open. When the sensor 94 detects the sensor 92, the signal 194 generated by sensor 94 can close the limit switch 1-LS. This closing can be accomplished, for a possible embodiment, by a solid state switch (not shown) closing in reaction to the adjusting signal 194 transmitted by the sensor 94. Upon the closing of the limit switch 1-LS, both a control relay 1-CR and a solenoid SOL A can be energized. The solenoid SOL A can correspond to the solenoid 111 shown in FIG. 6, so the energization of solenoid SOL A can correspond to energization of solenoid 111, thereby preferably moving the valve 110 to valve position 113 and pressurizing the pneumatic cylinder 123.

The energization of control relay 1-CR can close normally open contacts 1-CR-A. These normally open contacts 1-CR-A are preferably in series with normally closed contacts 2-CR-A, which normally closed contacts 2-CR-A can be controlled by a control relay 2-CR. Upon continued rotation of the impression cylinder 2, the sensor 94 can rotate past the sensor 92, preferably reopening limit switch 1-LS. However, control relay 1-CR can remain energized because the normally open contacts 1-CR-A are now preferably closed. Hence the solenoid SOL A can remain energized and the pneumatic cylinder 123 can remain pressurized and the washing device 1 can remain in cleaning contact with the impression cylinder 2.

The sensor 96 can, for a possible embodiment, also be considered a limit switch 2-LS that is normally open. When the sensor 96 detects the sensor 92, the signal 196 from the sensor 96 can close the limit switch 2-LS in a manner similar to the prior closing of limit switch 1-LS by sensor 94. Closing the limit switch 1-LS can energize control relay 2-CR, preferably opening the normally closed contacts 2-CR-A. This can deenergize both the control relay 1-CR and the solenoid SOL A, thereby preferably allowing the valve 110 to return to valve position 113 and depressurize the pneumatic cylinder 123. Upon continued rotation of the impression cylinder 2, the sensor 96 can rotate past the sensor 92, preferably reopening limit switch 2-LS and deenergizing control relay 2-CR to close the normally closed contacts 2-CR-A. Because both the limit switch 1-LS and the contacts 1-CR-A are now preferably open, the solenoid SOL A cannot reenergize until sensor 94 again senses or detects sensor 92 to repeat the process or cleaning cycle.

In other embodiments of the present invention, the control system shown in FIG. 7 can include manual or emergency shutoff controls, display devices, interlocks, cutoffs, monitoring functions, and diagnostic functions for example. Because these control systems are known, further detailed description will not be included herein.

One feature of the invention resides broadly in the cleaning device provided on a rotary printing machine for cleaning outer cylindrical surfaces of cylinders, said cleaning device comprising a cleaning cloth, a pressing-on bar for pressing the cleaning cloth on the outer cylindrical surface of a respective cylinder, said cleaning cloth being wettable with a cleaning fluid, and comprising adjusting devices for engaging and disengaging said pressing-on bar with said cleaning cloth, the cylinder to be cleaned featuring gripper fingers in a cylinder gap, characterized in that after each cleaning cycle, following an adjusting signal, a pressing-on bar 6 is lifted by means of a lifting element 27 above the level of gripper fingers 17, that in the area of said gripper fingers 17 a cylinder 2 features at least one cam segment 22, that a pivoting lever 20 with a cam roll 21 is provided on said pressing-on bar 6 that in the area of said gripper fingers 17 a pressing-on force is applied to said pressing-on bar 6 and said cam roll 21 contacts the highest cam section, and that said cam segment 22 then features a declining cam section 34 so that, after having passed said gripper fingers 17, said pressing-on bar 6 is engaged, via said cam roll 21 and said pivoting lever 20, at the outer cylindrical surface over the entire cylinder width, when further rotating said cylinder.

Another feature of the invention resides broadly in the cleaning device characterized in that pneumatic cylinders 23 are assigned to the pressing-on bar 6, said pneumatic cylinders 23 producing the pressing-on force and pressing the cleaning cloth 13 on the outer cylindrical surface 19 via an elastic profile rail 12 provided on said pressing-on bar 6.

Yet another feature of the invention resides broadly in the cleaning device characterized in that an adjusting signal switches off the overpressure in the pneumatic cylinder 23, and that lifting elements designed as springs 27 are provided on the pressing-on bar 6 in the area of a cylinder gap 15.

Still another feature of the invention resides broadly in the cleaning device characterized in that, when being in a lifted position, the pressing-on bar 6 is engaged at a supporting frame 5 via stops 33, and that, when being in an engaged position, it may be adjusted by means of adjusting screws 30,31.

A further feature of the invention resides broadly in the cleaning device characterized in that the pressure in the pneumatic cylinders 23 is controlled by means of an angular transmitter.

Another feature of the invention resides broadly in the cleaning device characterized in that an adjusting signal for the lifting element 27 is transmitted by an angular transmitter connected to the cylinder 2.

Example devices for cleaning cylinder surfaces in printing presses which could be adapted for use in the context of the present invention, and which example devices illustrate other components that can possibly be used in conjunction with the present invention, can be disclosed by the following U.S. Patents, each assigned to the assignee of the present invention: U.S. Pat. No. 5,174,209, U.S. Pat. No. 5,375,522, U.S. Pat. No. 5,365,849 and U.S. Pat. No. 5,452,660.

Additional example devices for cleaning cylinder surfaces in printing presses which could be adapted for use in the context of the present invention, and which example devices illustrate other components that can possibly be used in conjunction with the present invention can be disclosed by the following U.S. Patent Applications, each assigned to the assignee of the present invention: Ser. No. 08/515,793, Ser. No. 08/784,402.

Other examples of cleaning devices for printing presses which may be utilized in accordance with the present invention can be found in the following U.S. Patents: U.S. Pat. No. 4,344,361, U.S. Pat. No. 4,651,644, U.S. Pat. No. 4,922,821, U.S. Pat. No. 4,981,078, U.S. Pat. No. 4,991,507, U.S. Pat. No. 5,105,740, U.S. Pat. No. 5,150,650 and U.S. Pat. No. 5,537,924.

Examples of valves that could be used or could be adapted for use in accordance with the present invention, as well as components generally used with valves could be disclosed in the following U.S. Patents: U.S. Pat. No. 5,520,217, U.S. Pat. No. 5,227,868, U.S. Pat. No. 4,995,424, U.S. Pat. No. 4,567,914 and U.S. Pat. No. 4,526,201.

Examples of registration or gripping devices for clamping or gripping foils and printing plates to plate cylinders or impression cylinders of printing presses that could be used in accordance with the present invention could be found in the following U.S. Patents, each of which are assigned to the assignee of the present invention: U.S. Pat. No. 4,831,931, U.S. Pat. No. 5,014,619, U.S. Pat. No. 5,076,165, U.S. Pat. No. 5,088,409, U.S. Pat. No. 5,249,522, U.S. Pat. No. 5,272,978, U.S. Pat. No. 5,440,984, U.S. Pat. No. 5,473,983 and U.S. Pat. No. 5,488,904.

Additional examples of registration or gripping devices for clamping or gripping foils and printing plates to plate cylinders or impression cylinders of printing presses that could be used in accordance with the present invention could be found in the following U.S. Patents: U.S. Pat. No. 5,596,928, U.S. Pat. No. 5,503,072, U.S. Pat. No. 5,495,804, U.S. Pat. No. 5,461,980, U.S. Pat. No. 4,831,931 and U.S. Pat. No. 4,831,931.

Examples of measurement devices for the determination of a rotary angle of a shaft, which measurement devices could be adapted for use in the context of the present invention, can be found in the following U.S. Patents: U.S. Pat. No. 5,473,237, U.S. Pat. No. 5,444,370, U.S. Pat. No. 5,444,369, U.S. Pat. No. 5,430,372, U.S. Pat. No. 5,428,290 and U.S. Pat. No. 5,424,535.

Other examples of measurement devices, pneumatic circuits, pneumatic systems, control circuits, and control systems adaptable for use in the context of the present invention, as well as commonly accepted pneumatic circuitry and control circuitry symbols can be found in the following publications: *Design of Automatic Machinery,* copyright 1985 and authored by Kendrick W. Lentz, Jr., published by Van Nostrand Reinhold Company Inc. and having ISBN number 0-442-26032-6 and Library of Congress Catalog Card Number 84-3513; and *Pneumatics and Hydraulics,* fourth edition, copyright 1984, authored by Harry L. Stewart and revised by Tom Philbin, published by the Bobbs-Merrill Company, Inc. and having ISBN Number 0-672-23412-2.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 196 11 126.9, filed on Mar. 21, 1996, having inventors Willi Becker, Jens Friedrichs, and Frank Kropp, and DE-OS 196 11 126.9 and DE-PS 196 11 126.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A cleaning device for cleaning an outer cylindrical surface of a cylinder having gripper fingers, which cylinder rotates about an axis of rotation in a rotary printing machine, which rotary printing machine comprising a cam disposed on the cylinder of the rotary printing machine, which cam comprises a cam surface having first and second ends separated by the length of the cam surface, which first end of the cam surface precedes the second end of the cam surface in a normal direction of rotation of a cylinder, which first end of the cam surface is disposed a first radial distance from the axis of rotation of the cylinder, which second end of the cam surface is disposed a second radial distance from the axis of rotation of a cylinder, which second radial distance is less than the first radial distance, which surface of the cam descends radially inwards towards the axis of rotation of the cylinder along at least a part of the length of the surface from the first end to the second end of the surface, wherein a displacement of a cylinder of a rotary printing machine from a second position of a cylinder to a first position of a cylinder represents a cleaning cycle of a cylinder of a rotary printing machine, which cylinder being disposed in a second position represents a beginning of a cleaning cycle; and which cylinder being disposed in a first position represents an end of a cleaning cycle, said cleaning device comprising:

a body;

said body being configured to permit a cloth to be disposed thereon to clean an outer cylindrical surface of a rotary printing machine;

apparatus to move said body between a first position and a second position;

said body being disposed to permit a cleaning cloth to contact an outer cylindrical surface of a rotary printing machine upon said body being disposed in said first position;

said second position of said body being a substantial distance from an outer cylindrical surface of a rotary printing machine;

said apparatus to move said body being disposed to permit movement of said body to clear gripper fingers which gripper fingers are disposed upon a cylinder of a rotary printing machine;

said apparatus to move said body being disposed to permit movement of said body towards a cylinder of a rotary printing machine to thus contact a cleaning cloth with an outer cylindrical surface of a cylinder;

a cam follower being operatively connected to said body to guide at least a portion of the movement of said body;

said cam follower being disposed to contact a camming surface disposed on a cylinder of a rotary printing machine to permit the guiding of at least a portion of the movement of said body;

said apparatus to move said body comprising structure to apply a first force to said body to move said body away from a cylinder of a rotary printing press;

said apparatus to move said body comprising a lever;

said lever being configured to be pivotally mounted to a rotary printing machine;

said lever being configured to pivot about a pivoting axis substantially parallel to an axis of rotation of a cylinder of a rotary printing machine;

each of said body and said cam follower being attached to said lever to cooperatively pivot about a pivoting axis with said lever;

said lever being pivotable between a first position and a second position;

the first position of said lever corresponds to the first position of said body;

the second position of said lever corresponds to the second position of said body;

said cam follower being disposed to guide at least a portion of the pivoting of said lever;

said cam follower being disposed to permit contact with a cam surface to guide at least a portion of the movement of said body;

said apparatus to move said body comprising structure to apply a second force to said body to move said body towards a cylinder of a rotary printing press;

said cleaning device comprising structure to send a first signal upon completion of a cleaning cycle;

said apparatus structure to apply a first force comprising structure to receive a first signal upon an end of a cleaning cycle;

said apparatus structure to apply a first force comprising structure to apply the first force upon receipt of a first signal upon an end of a cleaning cycle;

said apparatus structure to apply a second force comprising structure to apply the second force upon a beginning of a cleaning cycle;

said cleaning device comprising structure to generate a second signal upon the beginning of a cleaning cycle;

said structure to receive a first signal further comprising structure to receive a second signal;

said structure to apply a second force comprising structure to apply the second force upon receipt by said structure to receive a signal of a second signal upon a beginning of a cleaning cycle;

said apparatus to move said body comprising structure configured to generate a first signal upon a cylinder of a rotary printing machine being disposed in a first position to end a cleaning cycle and to generate a second signal upon a cylinder of a rotary printing machine being disposed in a second position to begin a cleaning cycle;

at least a portion of said apparatus structure configured to generate a first signal and a second signal being configured to be disposed on a cylinder of a rotary printing machine;

said apparatus structure to apply a second force comprising at least one pneumatic cylinder;

said at least one pneumatic cylinder being configured to be operatively connected to a source of compressed air to pressurize said at least one pneumatic cylinder;

said at least one pneumatic cylinder being disposed to generate a second force upon pressurization of said at least one pneumatic cylinder;

said apparatus structure to apply a first force comprising structure to depressurize said at least one pneumatic cylinder upon receipt of a first signal;

said apparatus structure to apply a second force comprising structure to pressurize said at least one pneumatic cylinder upon receipt of a second signal;

said apparatus structure to apply a first force comprising at least one spring;

said at least one spring being operatively connected to said lever;

said at least one spring being disposed to store energy during motion of said body in the second direction to generate the first force upon depressurization of said at least one pneumatic cylinder;

said cleaning device comprising a frame;

said frame being configured to mount said lever on a rotary printing machine;

said cleaning device comprising a stop;

said stop being attached to one of: said frame and said body;

said stop being disposed to contact the other of said one of: said frame and said body upon said body being disposed in said second position to limit movement of said body;

said body comprising at least one bolt;

said at least one bolt being disposed to extend through said frame to divide said at least one bolt into a first portion and a second portion;

said second portion of said at least one bolt being disposed on the opposite side of said frame from the remainder of said body;

said cleaning device comprising a nut;

said nut being threadingly disposed on said second portion of said at least one bolt to limit movement of said body; and said nut being disposed to permit adjustment of said first position of said body.

2. The cleaning device according to claim 1, wherein:

said body comprises a member configured to extend along an outer cylindrical surface of a cylinder of a rotary printing machine;

said member is configured to be disposed substantially parallel with an axis of rotation of a cylinder of a rotary printing machine;

said member is configured to be disposed between a cleaning cloth disposed on said body and the remainder of said body; and said member is configured to elastically transfer the second force generated by said at least one pneumatic cylinder to press a cleaning cloth against an outer cylindrical surface of a cylinder of a rotary printing machine upon said body being disposed in the first position of said body.

3. The cleaning device according to claim 2, wherein:

said cleaning device comprises a cloth disposed on said body to clean an outer cylindrical surface of a cylinder of a rotary printing machine;

said cleaning cloth is wettable by a cleaning fluid; and said apparatus structure to apply a second force is configured to apply a second force during a cleaning cycle of a cylinder of a rotary printing machine.

4. A cleaning device for cleaning an outer cylindrical surface of a cylinder of a rotary printing machine, which cylinder comprises: a cylinder gap, and gripper fingers being disposed therein, said cleaning device comprising:

a cleaning cloth;

a pressing-on bar for pressing said cleaning cloth on the outer cylindrical surface of a respective cylinder;

an adjusting device for engaging and disengaging said pressing-on bar with said cleaning cloth;

a lifting element to lift said pressing-on bar;

after each cleaning cycle, following an adjusting signal, said pressing-on bar is lifted by said lifting element above the level of the gripper fingers;

in the area of said gripper fingers, a cylinder of a printing press comprises at least one cam segment;

a pivoting lever comprising a cam roll is disposed on said pressing-on bar;

in the area of the gripper fingers a pressing-on force is applied to said pressing-on bar; and said cam roll contacts the highest cam section, and that said cam segment then features a declining cam section so that, after having passed said gripper fingers, said pressing-on bar is engaged, via said cam roll and said pivoting lever, at the outer cylindrical surface over the entire cylinder width, when further rotating said cylinder.

5. The cleaning device according to claim 4, wherein:

said cleaning device comprises an elastic profile rail;

said elastic profile rail is disposed on said pressing-on bar;

at least one pneumatic cylinder is disposed to contact said pressing-on bar; and said at least one pneumatic cylinder produces the pressing-on force and presses the cleaning cloth on the outer cylindrical surface via said elastic profile rail.

6. The cleaning device according to claim 5, wherein:

said cleaning device comprises structure to generate an adjusting signal;

an adjusting signal from said structure to generate an adjusting signal switches off the overpressure in said at least one pneumatic cylinder; and said lifting element comprises springs, said springs being disposed on said pressing-on bar in the area of a cylinder gap.

7. The cleaning device according to claim 6, comprising;

a supporting frame;

stops to support said pressing-on bar;

adjusting screws to adjust said pressing-on bar;

when being in a lifted position, said pressing-on bar is engaged at said supporting frame via said stops; and said pressing-on bar being disposed to be adjustable by said adjusting screws upon said pressing-on bar being in an engaged position.

8. The cleaning device according to claim 6, comprising:

an angular transmitter; and the pressure in said at least one pneumatic cylinder being controlled by said angular transmitter.

9. The cleaning device according to claim 4, comprising:

an angular transmitter to transmit an adjusting signal;

said angular transmitter being disposed to be connected to a cylinder; and said angular transmitter being configured to transmit an adjusting signal to adjust said lifting element.

* * * * *